United States Patent [19]

Naito

[11] Patent Number: 4,824,288

[45] Date of Patent: Apr. 25, 1989

[54] CULVERT DRAINPIPE SYSTEM AND METHOD OF USE

[75] Inventor: Norie Naito, Fukui, Japan

[73] Assignee: Interpot International, Newport Beach, Calif.

[21] Appl. No.: 206,519

[22] Filed: Jun. 14, 1988

[51] Int. Cl.[4] ..... E02B 11/00; E02B 13/00

[52] U.S. Cl. ..... 405/48; 405/50; 405/124; 138/105; 138/42; 138/115; 138/166; 132/DIG. 11

[58] Field of Search ..... 405/43, 44, 45, 46, 405/47, 48, 36; 138/105, 103, 42, 111, 115, 166, DIG. 11, 116, 117, 128, 156, 106, 178, 177

[56] References Cited

U.S. PATENT DOCUMENTS

| | | | |
|---|---|---|---|
| 1,883,468 | 10/1932 | Barbour | 405/43 X |
| 1,959,633 | 5/1934 | Madden | 138/111 X |
| 3,625,258 | 12/1971 | Phelps | 138/115 |
| 4,016,727 | 4/1977 | Osaka et al. | 138/115 X |
| 4,061,272 | 12/1977 | Winston | 405/45 |
| 4,134,268 | 1/1979 | Elmore | 405/43 |
| 4,577,998 | 3/1986 | Dorrn | 138/177 X |

FOREIGN PATENT DOCUMENTS

| | | | |
|---|---|---|---|
| 2040151 | 8/1980 | United Kingdom | 405/43 |

*Primary Examiner*—Randolph A. Reese
*Assistant Examiner*—J. Russell McBee
*Attorney, Agent, or Firm*—Stetina and Brunda

[57] ABSTRACT

An improved culvert drainpipe and method of utilizing the same is disclosed characterized by use of an elongate thin wall extruded drainpipe element formed having a generally S-shaped configuration defining a pair of main flow channels and including plural curvilinear projections extending axially along the exterior of the element. The distal edges of the drainpipe element cooperate with one or more elongate wall extensions formed on the interior of the drainpipe element which prevent radial compression and/or collapse of the drainpipe element and deter debris from entering into the main the flow channels. In use, multiple drainpipe elements are bundled together in a generally parallel axis orientation whereby the curvilinear projections serve as secondary flow channels, improve debris segregation, and maintain space between adjacent drainpipe elements.

15 Claims, 2 Drawing Sheets

Fig. 1
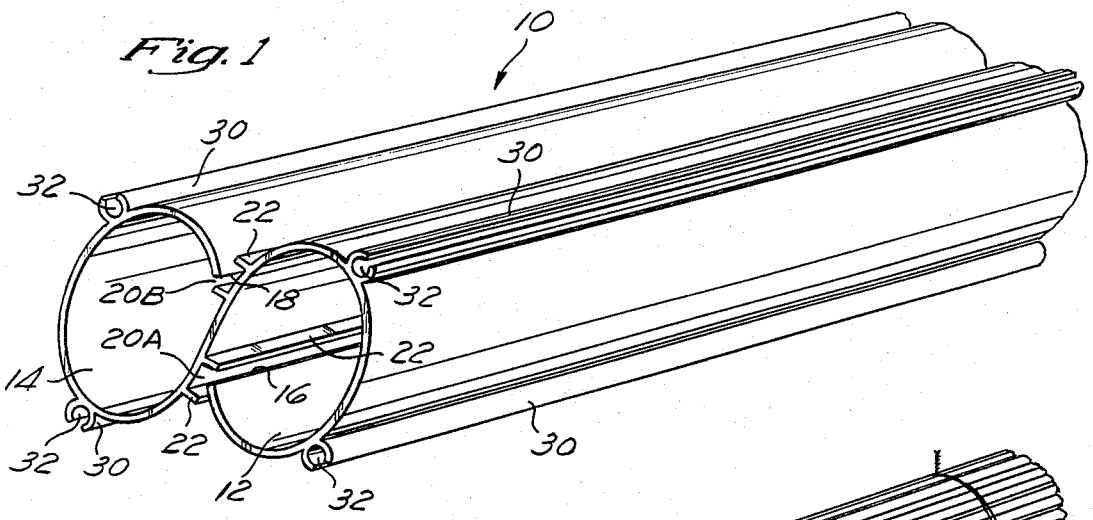
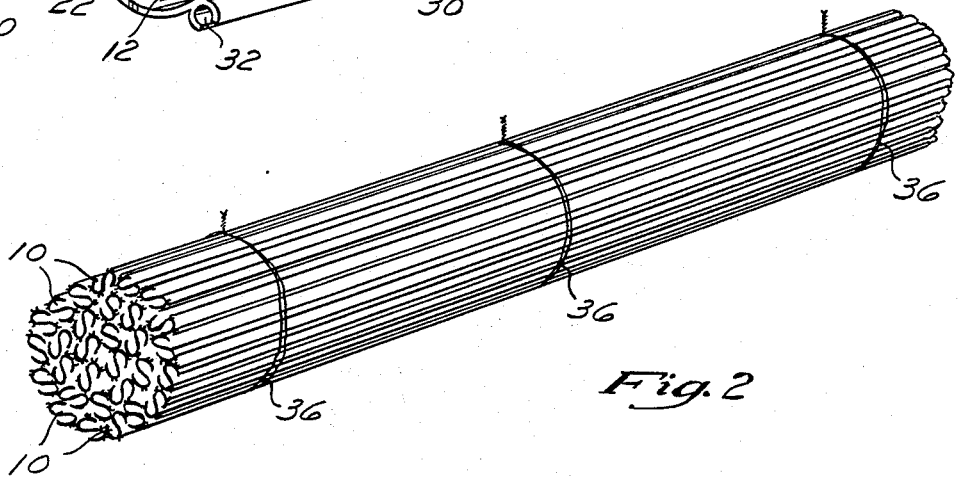
Fig. 2
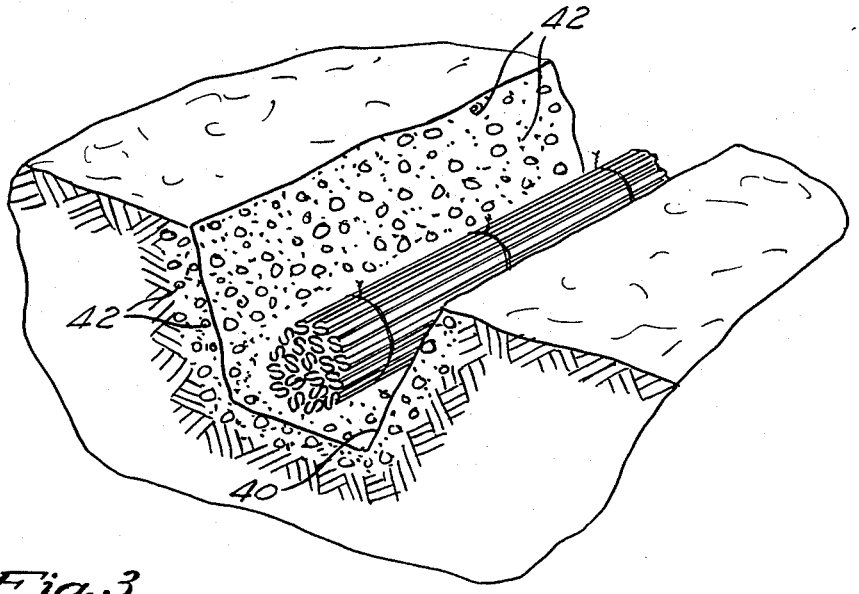
Fig. 3

Fig. 4
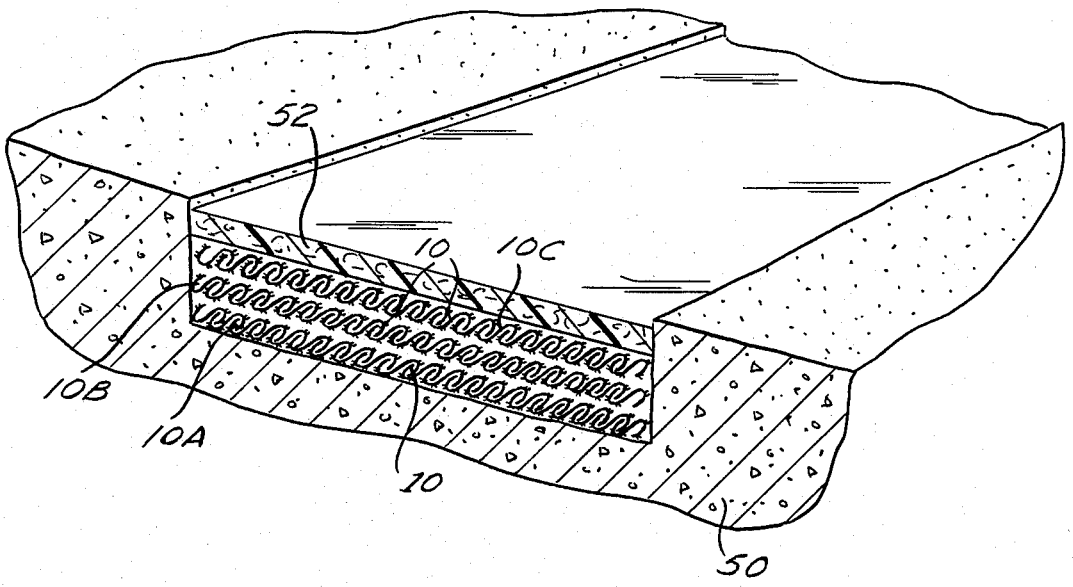
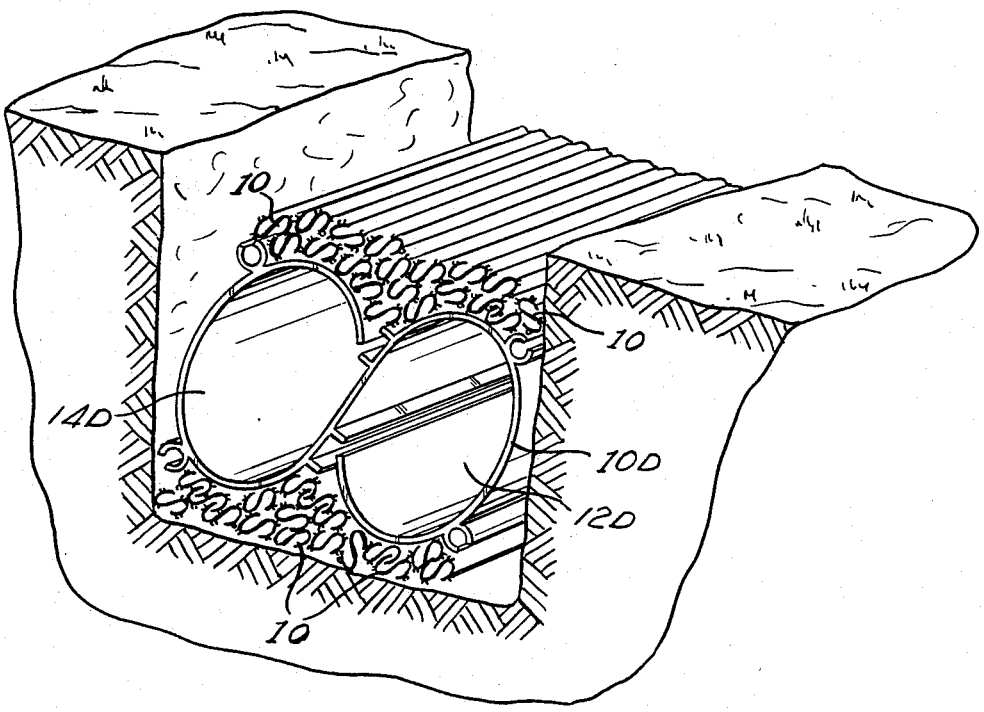
Fig. 5

CULVERT DRAINPIPE SYSTEM AND METHOD OF USE

FIELD OF USE

The present invention relates generally to subterranean drainage systems and more particularly to an improved culvert drainpipe and method of utilizing the same characterized by use of an elongate thin wall extruded drainpipe element formed having a generally S-shaped configuration and including plural curvilinear projections extending axially along the exterior of the element.

BACKGROUND OF THE INVENTION

As is well known, it is oftentimes necessary, if not desirable, to drain subterranean spring water and/or penetrated ground water from a particular geological site. Examples of the prior art drainage systems are numerous comprising such apparatus as perforated plastic tubes, concrete pipe with small apertures formed therein, bamboo pipe, gravel stones, and the like all of which have been used for culvert drainage applications Basically the required functions of such drainage systems are to initially draw water from the subterranean formation into the drainage system, subsequently provide a flow channel for the accumulated water through the drainage system, and preferably provide moderate resistance to geological concerns, such as degregation (i.e., decay) caused by the weight of the overburden upon the drainage system and clogging of the system through environmental debris buildup. Although nearly all of the prior art drainage systems heretofor utilized have proven generally effective when initially positioned within a formation, nearly all of the prior art systems have proved deficient in their ability to maintain their required function for prolonged periods of time. Primarily these deficiencies have been caused due to their inability to sufficiently resist internal debris buildup or degregation caused by exposure to the environment over prolonged time duration. As will be recognized, upon degregation or debris buildup, the removal and reinstallation of a substitute drainage system often proves difficult and extremely costly due to the fact that substantial overburden must be removed from the culvert prior to replacement of the same.

As such there exists a substantial need in the art for an improved culvert drainage system and method of use which functions to draw water from the subterranean formation, provides an unobstructed flow path for the accumulated ground water out of the formation, is capable of resisting degregation caused by prolonged exposure to environmental concerns, and resist debris buildup.

SUMMARY OF THE PRESENT INVENTION

The present invention specifically addresses and alleviates the above-referenced need associated in the art by providing an improved subterranean drainage system. More particularly, an improved culvert drainpipe and method of utilizing the same is disclosed which is characterized by use of an elongate thin wall extruded drainpipe element The drainpipe element is formed having a generally S-shaped configuration defining a pair of main flow channels therewithin and includes plural curvilinear C-shaped projections extending axially along the exterior of the element. The distal edges of the drainpipe element define axially extending slits which serve to allow entry of ground water from the formation to flow into the main flow channels of the element and subsequently be removed from the formation. The distal edges of the drainpipe element cooperate with one or more elongate wall extensions formed on the interior of the drainpipe element which prevent radial compression and/or collapse of the drainpipe element and additionally deter debris from entering into the main flow channels formed within the interior of the drainpipe element.

In use, multiple drainpipe elements are bundled together in a generally parallel axial orientation and are buried underground. As ground spring water and/or penetrated ground water contacts the bundled drainpipe elements, it is drawn by surface tension and gravity forces onto the exterior of the drainpipe element. Subsequently, the accumulated water enters the interior of the drainpipe element to be disposed within the main flow channels by entry through the elongate axial slits formed adjacent the distal edges of the drainpipe element and may travel by gravity through the main flow channels of the element.

Due to the distal edges of the drainpipe element cooperating with one or more elongate wall extensions formed on the interior of the drainpipe element, radial compression and/or collapse of the drainpipe element is prohibited thereby insuring that the main flow channels remain substantially intact throughout prolonged duration.

In addition, the curvilinear projections formed on the exterior of the drainpipe element serve to maintain sufficient spacing between adjacent drainpipe elements maintained within the bundled configuration as well as serve as secondary flow channels for accumulated water drawn to the drainpipe elements. The curvilinear extensions additionally serve to deter entry of debris from the formation, i.e. silt, rocks, and the like, into the main flow channels of each of the drainpipe elements, thereby insuring prolonged operational use.

In the preferred embodiment, the drainpipe element is formed of an extruded thin wall polyvinyl chloride (pvc) and/or acrylonitrile-butadiene-styrene (abs) material which resists environmental degregation for prolonged duration. In addition, the present invention contemplates formation of the drainpipe elements having relatively long axial lengths, i.e. approximately 20 feet, which when bundled in a manner previously described may subsequently be abutted in an end-for-end orientation to have sufficient length for nearly all culvert drainage applications.

DESCRIPTION OF THE DRAWINGS

These as well as other features of the present invention will become more apparent upon reference to the drawings wherein:

FIG. 1 is a perspective view of the drainpipe element of the present invention;

FIG. 2 is a perspective view illustrating the bundling of multiple drainpipe elements in a generally parallel axial orientation preparatory to placing the same in a subterranean, application;

FIG. 3 depicts the bundled multiple drainpipe elements of FIG. 2 disposed within a subterranean culvert formation;

FIG. 4 is a perspective view of multiple drainpipe elements juxtapositioned in multiple horizontal rows and placed within a concrete drainage culvert covered by a fiberglass mat; and FIG. 5 is a perspective view depicting the use of one differing sized drainpipe element disposed within a subterranean site utilized where large water flow applications are required.

DESCRIPTION OF THE PREFERRED EMBODIMENTS

Referring to the figures, the improved culvert drainpipe element 10 and method of use is depicted. The drainpipe element 10 comprises an elongate member formed having a generally S-shaped cross-sectional configuration. Typically, the drainpipe element 10 is extruded as a thin walled elongate member from a plastic material, such as polyvinyl chloride (pvc) or acrylonitrile-butadiene-styrene polymer (abs), however other suitable materials having sufficient resistance to environmental degregation may be utilized. Preferably the drainpipe element 10 is formed having long axial length (i.e. approximately 20 feet) and a cross-sectional configuration which may vary depending upon applicational use. However in the preferred embodiment, the cross-sectional size comprises approximately one and one-half inches in maximum length. Due to the S-shaped configuration of the drainpipe element 10, a pair of main flow channels or voids 12 and 14 are formed within the interior of the drainpipe element 10 which, as will be explained in more detail infra, serve as the main flow conduit for water within the interior of the element 10.

The distal edges 16 and 18 of the element 10 are spaced through a short distance from the central wall portion 19 of element 10 and define axially extending slots 20A and 20B which serve as an inlet for ground water disposed upon the exterior of the element 10 to within a respective flow channel 12 and 14. One or more wall extensions 22 are formed on opposite sides of the central wall portion 19 of the element 10 which straddle the distal edges 16 and 18 of the element 10. As may be recognized, the wall extensions 22 serve to capture the distal edges 16 and 18 of the element 10 and prevent the edges 16 and 18 from movement beyond the confines of the wall elements 22. As such, upon exertion of a compressive force against the drainpipe element 10, collapsing or substantial deformation of the thin wall of the drainpipe element 10 is prohibited thereby insuring the structural integrity of the flow channels 12 and 14.

The exterior surface of the drainpipe element 10 preferably includes plural curvilinear C-shaped channels 30 which extend axially throughout its length. Although in a preferred embodiment four of such curvilinear projections 30 are provided, those skilled in the art will recognize that variations in the number of the same are clearly contemplated herein. The interior portion of each of the curvilinear projections 30 define an elongate aperture 32 which, as will be explained in more detail infra, serves as a secondary or auxiliary flow channel for the drainpipe element 10.

With the structure defined, the operation of and method of utilizing the improved drainpipe element 10 of the present invention may be described. With specific reference to FIG. 2, multiple drainpipe elements 10 are preferably bundled together in a parallel axial orientation by one or more ties 36. As will be recognized, during this bundling procedure, the curvilinear projections 30 serve to maintain a small degree of spacing between adjacent drainpipe elements within the bundle.

Subsequently, the bundled drainpipe elements 10 are disposed within the interior of a culvert 40 formed in the earth formation and once positioned therewithin the culvert 40 may be filled with suitable water permeable substance, such as gravel and/or rocks 42 which facilitate filtered drainage of ground water and/or spring water therethrough and onto the bundled drainpipe elements 10. As will be recognized, in order to meet the demands of the application, multiple bundles of drainpipe elements 10 may be positioned in end-to-end orientation as desired.

As the ground water and/or spring water travels through the gravel 42 by gravity forces, it contacts the bundled drainpipe elements 10 and adheres to the same via surface tension. The accumulated water subsequently enters into the flow channels 12 and 14 of each of the drainpipe elements 10 via the elongate slot openings 20A and 20B formed adjacent the distal edges 16 and 18 of the element 10. Once the water has entered into the main flow channels 12 and 14, the same is free to flow unobstructed through the flow channels 12 and 14 of each of the elements 10 and be removed from the culvert 40 via gravity forces.

As will be recognized, the plural curvilinear projections 30 increase the external surface area of each of the drainpipe elements 10 and thereby serve to enhance the capability of the drainpipe 10 to accumulate ground water thereon. Further, it will be recognized that the curvilinear sections 30 additionally serve to maintain sufficient space between adjacent drainpipe elements 10 to deter compression of the individual drainpipe elements 10 within the bundle caused by the weight of the gravel 42 upon the bundled drainpipe elements 10. In addition, the curvilinear projections 30 help to prevent debris accumulation and clogging of the main flow channels 12 and 14 of the drainpipe element 10 by comprising small catch basins which serve to filter the ground water prior to entry into the main flow channels 12 and 14 thereby maintaining debris on the exterior surfaces only of the drainpipe elements 10. Finally, it will be recognized that the interior apertures 32 formed within the interior of each of the curvilinear projections 30 serve as small secondary flow paths to conduct ground water along the length of the drainpipe elements 10 in a manner analogous to that described in relation to the main flow channels 12 and 14.

As will be recognized as compressive forces are exerted upon the drainpipe elements 10 from the weight of the gravel 42 and ground water accumulating thereon, the distal edges 16 and 18 of the drainpipe element 10 are urged toward the central wall portion 19 of the element 10. However, upon contact with the wall projections 22 formed on the central wall portion 19, further inward movement of the edges 16 and 18 is prevented, thereby insuring the structural integrity and maintenance of an unobstructed flow path within the main flow channels 12 and 14. Additionally, the wall projections 22 serve to form a maze-like structure adjacent the axial inlets 20A and 20B forming the entrance into the main flow channels 12 and 14 which serves to deter the entry of silt, sand, and the like within the interior of the flow channels 12 and 14. Thus, the drainpipe element 10 of the present invention is capable of remaining substantially free from debris obstructions during prolonged use.

Referring to FIG. 4, an additional application of use of the drainpipe element 10 of the present invention is depicted. As shown, multiple drainpipe elements 10 may be arranged in an abutted side-by-side orientation. Preferably in such an arrangement, the distal edge 18 of each of the drainpipe elements 10 is positioned within the interior of the flow channel 12 formed in an adjacent one of the drainpipe elements 10 such that adjacent drainpipe elements 10 are maintained in an interlocked horizontal orientation. Subsequently multiple rows 10A, 10B, and 10C of the interlocked drainpipe elements 10 may be disposed within a concrete drain culvert or channel 50, as illustrated in FIG. 4. The stacked rows 10A, 10B, and 10C of the multiple drainpipe elements 10 may then be covered with a suitable layer 52 or mat of fiberglass which prevents visual sight of the drainpipe members 10 from ground surface. As will be recognized, the fiberglass layer or mat 52 serves to filter ground water or the like accumulating thereon while allowing the passage of ground water to pass through the thickness of the mat 52 and contact the drainpipe elements 10. Upon contact, the ground water enters the interior flow channels 12 and 14 of the individual drainpipe elements 10 and is free to flow by gravity forces within the interior of the same.

FIG. 5 illustrates an additional embodiment of the present invention specifically adapted for applications requiring large flow rate drainage applications. In this embodiment, one or more of the drainpipe elements 10D is formed having an extremely large cross-sectional dimension whereby two large flow channels 12D and 14D are provided within the interior of the element 10D. Multiple smaller sized drainpipe elements 10 may then be positioned about the exterior of the enlarged drainpipe element 10D and bundled together in a manner previously described. The resultant bundled drainpipe elements 10 and 10D may then be positioned within a culvert 40 and covered with suitable gravel 42 in a manner described in relation to FIG. 3.

In such an embodiment, it will be recognized that the plural drainpipe elements 10 serve a filtering function for the main enlarged drainpipe element 10D which deters debris from entering into the main flow channels 12D and 14D of the enlarged drainpipe element 10D. As such, unrestricted flow of large volumes of water within the interior of the flow channels 12D and 14D is facilitated.

Although for purposes of description specific materials, sizes, and structures have been defined herein, those skilled in the art will recognize that various modifications to the same may be made without departing from the spirit of the present invention and such modifications are clearly contemplated herein.

What is claimed is:

1. An improved culvert drainpipe comprising:

an elongate drainpipe element formed having a generally S-shaped cross-sectional configuration defining a pair of flow channels therein;

an axially extending inlet formed on each of said pair of flow channels;

a wall extension formed on said drainpipe element adjacent each inlet positioned to form an abutment for limiting movement of the distal edges of said drainpipe element; and plural curvilinear extensions formed axially on the exterior of said drainpipe element.

2. The improved culvert drainpipe of claim 1 wherein said wall extension comprises a pair of wall extensions positioned on opposite sides of the distal edges of said drainpipe element.

3. The improved culvert drainpipe of claim 2 wherein said wall extensions extend outwardly beyond the distal edges of said drainpipe to shield the axially extending inlet formed on each of said pair of flow channels.

4. The improved culvert drainpipe of claim 3 wherein said plural curvilinear extensions are formed having a generally C-shaped cross-sectional configuration.

5. The improved culvert drainpipe of claim 4 wherein said drainpipe element comprises a thin-wall extruded drainpipe element.

6. The improved culvert drainpipe element of claim 5 wherein said drainpipe element is fabricated from a plastic material.

7. The improved culvert drainpipe element of claim 6 wherein said plastic material comprises polyvinyl-chloride.

8. The improved culvert drainpipe element of claim 6 wherein said plastic material comprises acrylonitrile-butadiene-styrene.

9. The improved culvert drainpipe element of claim 5 further comprising:

an assembly of plural drainpipe elements bundled together in a parallel orientation.

10. A method of forming a culvert drainage system comprising the steps of:

forming an elongate drainpipe element having a generally S-shaped cross-sectional configuration and including plural C-shaped extensions formed axially along the exterior surface of said drainpipe element;

bundling plural elongate elements together in a parallel orientation;

disposing said bundled elongate elements into a culvert; and covering said bundled elongate elements with a water permeable filtering material.

11. The method of claim 10 wherein said covering step comprises covering said bundled elongate elements with gravel.

12. The method of claim 10 wherein said covering step comprises covering said bundled elongate elements with a fiberglass mat.

13. The method of claim 10 wherein said bundling step comprises the steps of:

arranging plural elongate elements in a parallel orientation defining a substantially circular cross-sectional configuration; and tying said plural elongate elements together

14. The method of claim 10 wherein said bundling step comprises:

arranging plural elongate elements in an interconnected side-by-side orientation.

15. The method of claim 14 wherein said disposing step comprises vertically stacking plural interconnected side-by-side orientation elements in the culvert.

* * * * *